US010434765B2

(12) United States Patent
Fukazawa

(10) Patent No.: US 10,434,765 B2
(45) Date of Patent: Oct. 8, 2019

(54) PRINTING CONTROL APPARATUS, PRINTING CONTROL METHOD, AND MEDIUM STORING PRINTING CONTROL PROGRAM

(71) Applicant: SEIKO EPSON CORPORATION, Tokyo (JP)

(72) Inventor: Masahiro Fukazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/816,139

(22) Filed: Nov. 17, 2017

(65) Prior Publication Data

US 2018/0147833 A1 May 31, 2018

(30) Foreign Application Priority Data

Nov. 30, 2016 (JP) ..... 2016-232940

(51) Int. Cl.
*B41J 2/045* (2006.01)
*B41J 2/21* (2006.01)

(52) U.S. Cl.
CPC ..... *B41J 2/0451* (2013.01); *B41J 2/04508* (2013.01); *B41J 2/04581* (2013.01); *B41J 2/04586* (2013.01); *B41J 2/04593* (2013.01); *B41J 2/2139* (2013.01); *B41J 2/2146* (2013.01)

(58) Field of Classification Search
CPC ..... B41J 2/2139; B41J 2/0451; B41J 29/393; B41J 2/04586; B41J 2/04581; B41J 2/2146; B41J 2/2142; B41J 2/04508; B41J 29/38; B41J 2/04593
USPC ..... 347/9, 12, 13, 14, 19, 42
See application file for complete search history.

(56) References Cited

U.S. PATENT DOCUMENTS

2016/0089882 A1* 3/2016 Ishida ..... B41J 2/2139 347/12

FOREIGN PATENT DOCUMENTS

JP 09-118023 A 5/1997

* cited by examiner

*Primary Examiner* — Jannelle M Lebron

(57) ABSTRACT

A specifying section specifies in printing data a first dot position at which a defective nozzle discharges an ink droplet to print the ink droplet on a medium when the defective nozzle is not defective, but is normal, and specifies in printing data a second dot position different from the first dot position based on priority information in which priority is set for each pixel. A data correcting section corrects the printing data. The collecting corresponds to allocating an amount of ink of the first dot position to the second dot position. When the first dot position at which the ink droplet is provided to the medium if the defective nozzle is not defective is specified, a neighboring second dot position different from the first dot position is specified based on the preset priority information, and the data correcting section corrects the printing data so as to allocate the amount of ink to the second dot position based on the mount of ink of the first dot position.

10 Claims, 10 Drawing Sheets

FIG. 6A

| | | | | | | |
|---|---|---|---|---|---|---|
| 1 | 2 | 3 | 3 | 3 | 2 | 3 |
| 1 | 3 | 2 | 1 | 2 | 2 | 2 |
| 3 | 2 | 1 | 1 | 3 | 3 | 3 |
| 3 | 2 | 2 | 3 | 3 | 1 | 1 |
| 2 | 3 | 1 | 3 | 3 | 1 | 2 |

FIG. 6B

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 2 | 2 | 3 | 3 | 1 | 1 |
| 2 | 3 | 1 | 3 | 3 | 1 | 2 |

OMITTED PIXEL

FIG. 6C

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 2 | 2 | 3 | 3 | 1 | 1 |
| 2 | 3 | 1 | 3 | 3 | 1 | 2 |

OMITTED PIXEL

FIG. 6D

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 2 | 2 | 3 | 3 | 1 | 1 |
| 2 | 3 | 1 | 3 | 3 | 1 | 2 |

OMITTED PIXEL

FIG. 6E

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 3 | 2 | 3 | 3 | 1 | 1 |
| 2 | 3 | 1 | 3 | 3 | 1 | 2 |

OMITTED PIXEL

FIG. 7A

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | ~~8~~ | 1 | 1 | 3 | 3 | 3 |
| 3 | 3 | 2 | 3 | 3 | 1 | 1 |
| 2 | 3 | 1 | 3 | 3 | 1 | 2 |

OMITTED PIXEL

FIG. 7B

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | ~~8~~ | 1 | 1 | 3 | 3 | 3 |
| 3 | 3 | 2 | 3 | 3 | 1 | 1 |
| 2 | 3 | 1 | 3 | 3 | 1 | 2 |

OMITTED PIXEL

FIG. 7C

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | ~~8~~ | 1 | 1 | 3 | 3 | 3 |
| 3 | 3 | 3 | 3 | 3 | 1 | 1 |
| 2 | 3 | 1 | 3 | 3 | 1 | 2 |

OMITTED PIXEL

FIG. 7D

| | | | | | | |
|---|---|---|---|---|---|---|
| 1 | 2 | 3 | 3 | 3 | 2 | 3 |
| 3 | 3 | 3 | 1 | 2 | 2 | 2 |
| ~~8~~ | ~~8~~ | 1 | 1 | 3 | 3 | 3 |
| 3 | 3 | 3 | 3 | 3 | 1 | 1 |
| 2 | 3 | 1 | 3 | 3 | 1 | 2 |

OMITTED PIXEL

FIG. 9

REPLACEMENT TABLE

| A OR C | 0 | 0 | 0 | 0 | 1 | 1 | 1 | 1 | 2 | 2 | 2 | 2 | 3 | 3 | 3 | 3 |
|---|---|---|---|---|---|---|---|---|---|---|---|---|---|---|---|---|
| B | 0 | 1 | 2 | 3 | 0 | 1 | 2 | 3 | 0 | 1 | 2 | 3 | 0 | 1 | 2 | 3 |
| B' | 0 | 1 | 2 | 3 | 1 | 2 | 3 | 3 | 2 | 3 | 3 | 3 | 3 | 3 | 3 | 3 |
| C' | 0 | 0 | 0 | 0 | 0 | 0 | 1 | 2 | 0 | 0 | 1 | 2 | 0 | 1 | 2 | 3 |

FIG. 10A

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 2 | 2 | 3 | 3 | 1 | 1 |
| 2 | 3 | 1 | 3 | 3 | 1 | 2 |

OMITTED PIXEL

FIG. 10B

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 2 | 2 | 3 | 3 | 1 | 1 |
| 2 | 3 | 1 | 3 | 3 | 1 | 2 |

OMITTED PIXEL

FIG. 10C

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 2 | 2 | 3 | 3 | 1 | 1 |
| 2 | 3 | 1 | 3 | 3 | 1 | 2 |

OMITTED PIXEL

FIG. 10D

| | | | | | | |
|---|---|---|---|---|---|---|
| 1 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 3 | 2 | 3 | 3 | 1 | 1 |
| 2 | 3 | 1 | 3 | 3 | 1 | 2 |

OMITTED PIXEL

FIG. 10E

| | | | | | | |
|---|---|---|---|---|---|---|
| 2 | 2 | 3 | 3 | 3 | 2 | 3 |
| 3 | 3 | 2 | 1 | 2 | 2 | 2 |
| ~~8~~ | 2 | 1 | 1 | 3 | 3 | 3 |
| 3 | 3 | 3 | 3 | 3 | 1 | 1 |
| 2 | 3 | 1 | 3 | 3 | 1 | 2 |

OMITTED PIXEL

PRINTING CONTROL APPARATUS, PRINTING CONTROL METHOD, AND MEDIUM STORING PRINTING CONTROL PROGRAM

BACKGROUND

1. Technical Field

The present invention relates to a printing control apparatus, a printing control method, and a medium storing a printing control program, the apparatus, the method, and the program capable of performing printing by intermittently transporting a printing medium in a sub-scanning direction while reciprocating a printing head in a main scanning direction.

2. Related Art

An ink jet recording apparatus is required to have nozzles with a decreased diameter to improve drying speed and increase precision. In accordance with the decreased diameter of the nozzles, the nozzles are likely to be clogged due to solidification of ink. When a nozzle is clogged and cannot discharge ink, a white streak may be generated at a position corresponding to the nozzle.

The ink jet recording apparatus according to JP-A-9-118023 includes an output data changer that changes output data of the output memory by taking the logical sum of output data for a nozzle and output data for one of the nozzles adjacent to the nozzle. Therefore, even if a dot corresponding to the clogged portion is not printed due to clogging of the nozzle, a dot is printed at an adjacent position. That is, even when the output data is unable to be realized due to a clogged defective nozzle (discharge defect), the output data of the missed portion is printed by the adjacent nozzle, and the output data of the missed portion can be realized.

According to the related art described above, when the output data of the defective nozzle is "1" and output data of a non-defective adjacent nozzle is "1", the output data of the adjacent nozzle after taking the logical sum does not become "1" or more. Therefore, an effect of output data for the defective nozzle being supplemented by output data for the non-defective adjacent nozzle disappears. Specifically, an expected print density cannot be expressed. In addition, there is room for improvement for a measure against output data not being realized due to the defective nozzle in an ink jet recording apparatus that uses multi-size dots.

SUMMARY

An advantage of some aspects of the invention is to provide a printing control apparatus, a printing control method, and a medium storing a printing control program that maintain a print density even when a defective nozzle exists.

A printing control apparatus according to an aspect of the invention includes a position information acquiring section that acquires a position of a defective nozzle of a plurality of nozzles discharging ink onto a medium, a data generating section that generates printing data related to dot positions corresponding to positions of dots at which ink droplets are printed on the medium and amounts of ink discharged to the dot positions, a specifying section that specifies in the printing data a first dot position at which the defective nozzle discharges an ink droplet to print the ink droplet on the medium when the defective nozzle is not defective and specifies in the printing data a second dot position different from the first dot position based on priority information in which priority is set for each pixel, and a data correcting section that corrects the printing data, the correcting corresponding to a process of allocating an amount of ink of the first dot position to the second dot position.

In the above configuration, the position information acquiring section acquires the position of the defective nozzle having, for example, a discharge defect of the plurality of nozzles discharging the ink onto the medium, and the data generating section generates the printing data related to the dot positions corresponding to the positions of the dots at which the ink droplets are printed on the medium and the amounts of ink discharged to the dot positions.

In addition, the specifying section specifies in the printing data the first dot position at which the defective nozzle discharges the ink droplet to print the ink droplet on the medium when the defective nozzle is not defective, but is normal, and specifies in the printing data the second dot position different from the first dot position based on the priority information in which priority is set for each pixel, and the data correcting section corrects the printing data, the correcting corresponding to the process of allocating the amount of ink of the first dot position to the second dot position.

As described above, if the first dot position at which the ink droplet is provided to the medium when the defective nozzle is not defective is specified, the second dot position different from the first dot position is specified based on the preset priority information. For example, a neighboring dot position is a candidate dot position. Then, the printing data is corrected so that the amount of ink of the first dot position is allocated to the second dot position based on the amount of ink of the first dot position. The allocation is performed based on the amount of ink, and thus, there is an effect of printing data for the first dot position being supplemented by printing data for the second dot position.

The specifying section may specify a lower-priority dot position different from a higher-priority dot position based on the priority information, and the data correcting section corrects the printing data, the correcting corresponding to a process of allocating to the lower-priority dot position an amount of ink that is allocated to the higher-priority dot position, but that is not completely covered with the higher-priority dot position.

There is a case in which a first ink amount of the first dot position is allocated to the second dot position, but is not completely covered with the second dot position. In the above configuration, the lower-priority dot position is specified based on the priority information, and the ink amount that is allocated to the higher-priority dot position, but is not completely covered with the higher-priority dot position is allocated to the lower-priority dot position.

When there is an insufficient amount of ink that is not completely covered, the next dot positions are sequentially specified to maintain the effect of supplementing the insufficient amount of ink.

BRIEF DESCRIPTION OF THE DRAWINGS

The invention will be described with reference to the accompanying drawings, wherein like numbers reference like elements.

FIGS. 6A to 6E are views illustrating an allocating process using a specific example.

FIGS. 7A to 7D are views illustrating an allocating process for the next omitted pixel.

FIG. 9 is a view illustrating contents of a replacement table.

FIGS. 10A to 10E are views illustrating an allocating process using a specific example.

DESCRIPTION OF EXEMPLARY EMBODIMENTS

First Embodiment

Hereinafter, an embodiment of the invention will be described with reference to the drawings.

Figure 1:
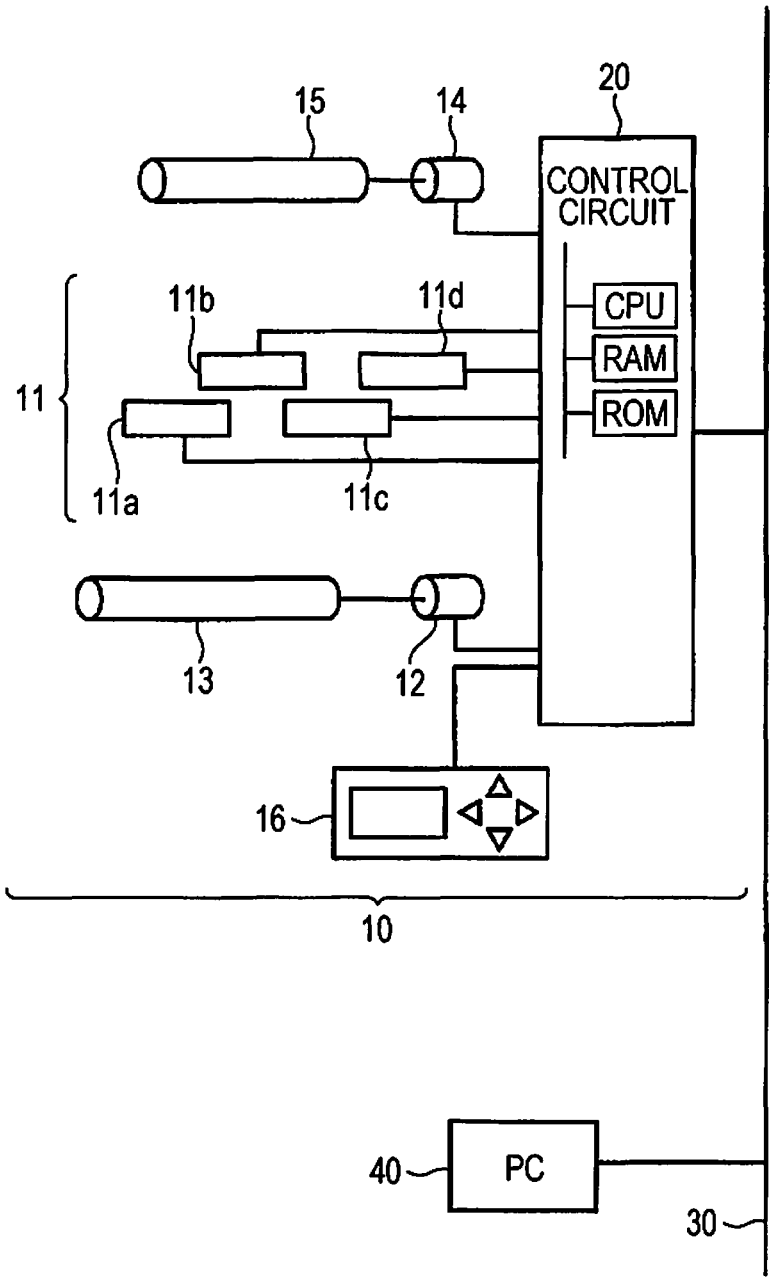
FIG. 1 is a block diagram of a printing system according to the invention.

FIG. 1 is a block diagram of a printing system according to the invention.

In FIG. 1, a printing head 11 of a printer (droplet discharge apparatus) 10 discharges color ink of four colors or six colors supplied from an ink tank through nozzles. Printing heads 11*a* to 11*d* are fixed at predetermined positions, and a platen 12 is rotated by a platen motor 13, such that paper is transported substantially orthogonally to the printing heads 11*a* to 11*d*. The printing heads 11*a* to 11*d* are arranged in a staggered zigzag shape in a longitudinal direction, and the nozzles face the paper over the entire width of the paper in a width direction. Accordingly, the printing heads 11*a* to 11*d* relatively move on the paper.

A feed motor 14 drives a paper feed roller 15 supplying paper accommodated in a predetermined paper stacker. A printer of the type described above in which the printing heads 11*a* to 11*d* are stopped and move relative to the transport of the paper is referred to as a line printer.

A control circuit 20 is formed by combining dedicated integrated circuits (ICs) with each other and functionally includes a central processing unit (CPU), a read-only memory (ROM), and a random access memory (RAM). The control circuit 20 controls driving of the printing heads 11*a* to 11*d*, the platen motor 13, and the feed motor 14. The control circuit 20 is mounted with an operation panel/display section 16, such that a predetermined operation by a user is accepted and a predetermined display is performed by the operation panel/display section 16. The abovementioned hardware is collectively referred to as a printing mechanism.

When the printer 10 is connected to a network 30 and acquires printing data from a personal computer (PC) 40 or the like through the network 30, the printer 10 performs printing corresponding to the printing data.

In the case of a line printer, when the paper is transported and printing is performed in a state in which any of the nozzles is clogged and does not discharge an ink droplet, the ink droplet does not adhere to a dot position facing the clogged nozzle, and a white streak appears at the dot position. Whether or not each nozzle is a clogged defective nozzle can be determined not only by using a chart for confirmation, but also by supplying a predetermined drive signal to a drive element of each nozzle.

Such a white streak is generated in a serial printer as well as a line printer.

Figure 2:
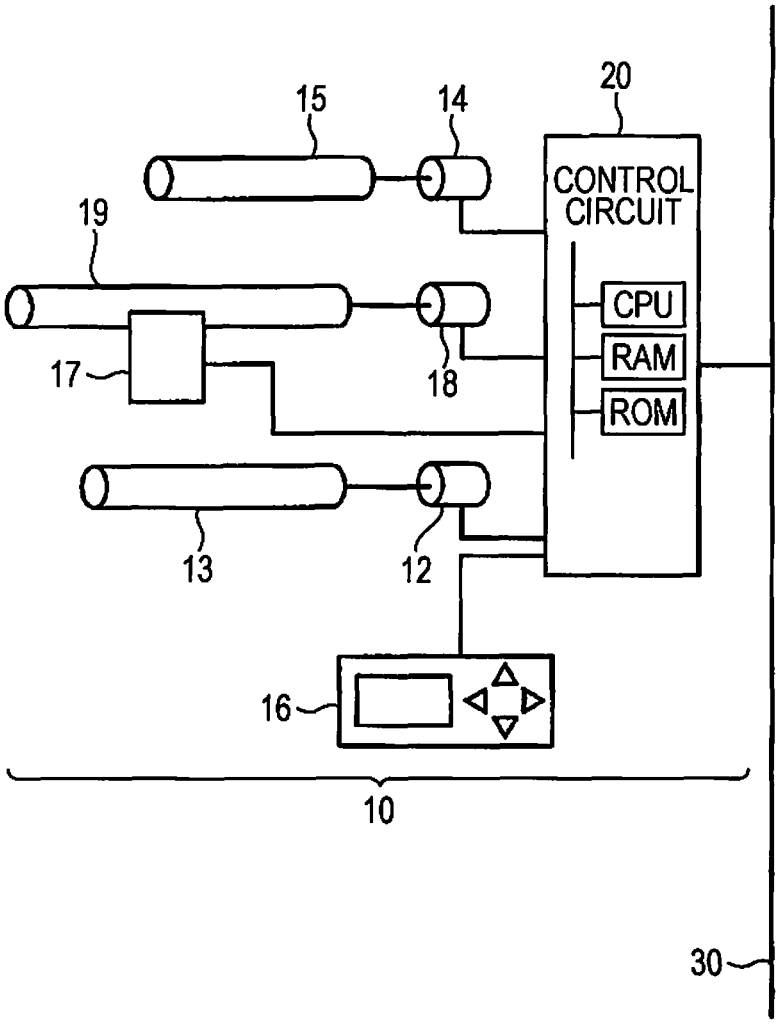
FIG. 2 is a block diagram of a serial printer.

FIG. 2 is a schematic block diagram of such a serial printer.

A printing head 17 in which nozzles are arranged in a feed direction of paper is reciprocated in a predetermined range by a belt 19 driven by a carriage motor 18. The type of printer described above in which the printing head 17 reciprocates in accordance with the transport of the paper is referred to by various names but herein is referred to as a serial printer.

In the case of a serial printer, when a nozzle is clogged, a white streak may be generated in a width direction of the paper on which the printing head 17 is driven.

The control circuit 20 outputs drive signals for discharging ink droplets by using the printing heads 11 and 17 and enables a plurality of ink droplets having different sizes, such as small, medium, and large to be discharged. Several methods of discharging such multi-size dots have been realized, but in the invention, a method of realizing the discharging of the multi-size dots is not particularly limited. Meanwhile, a small dot, a medium dot, and a large dot are selected based on printing data denoting an amount of ink, and ink droplets of different sizes are discharged based on a quantitative control similar to a print density control, regardless of parameters such as amount of ink, ink concentration, or dot diameter.

In the case of the serial printer, it is possible to perform printing not only such that an actual nozzle pitch and a dot pitch coincide with each other, but also such that a dot pitch is finer than a nozzle pitch by moving the paper. In the case where an actual nozzle pitch and a dot pitch coincide with each other, the nozzle position of a defective nozzle and the dot position correspond to each other. In other words, a nozzle discharging an ink droplet to a dot position adjacent to the dot position corresponding to the defective nozzle is actually a nozzle adjacent to the defective nozzle.

However, when the dot pitch is finer than the nozzle pitch, that is, when the entire printing area is covered with a plurality of passes, the nozzle discharging the ink droplets to the dot position adjacent to the dot position of the defective nozzle cannot but be determined in accordance with printing passes. Specifically, the dot position of the defective nozzle may be determined based on the printing data, content of pass decomposition, and information on the defective nozzle, and a nozzle corresponding to a dot position adjacent to the determined dot position is specified.

Figure 3:
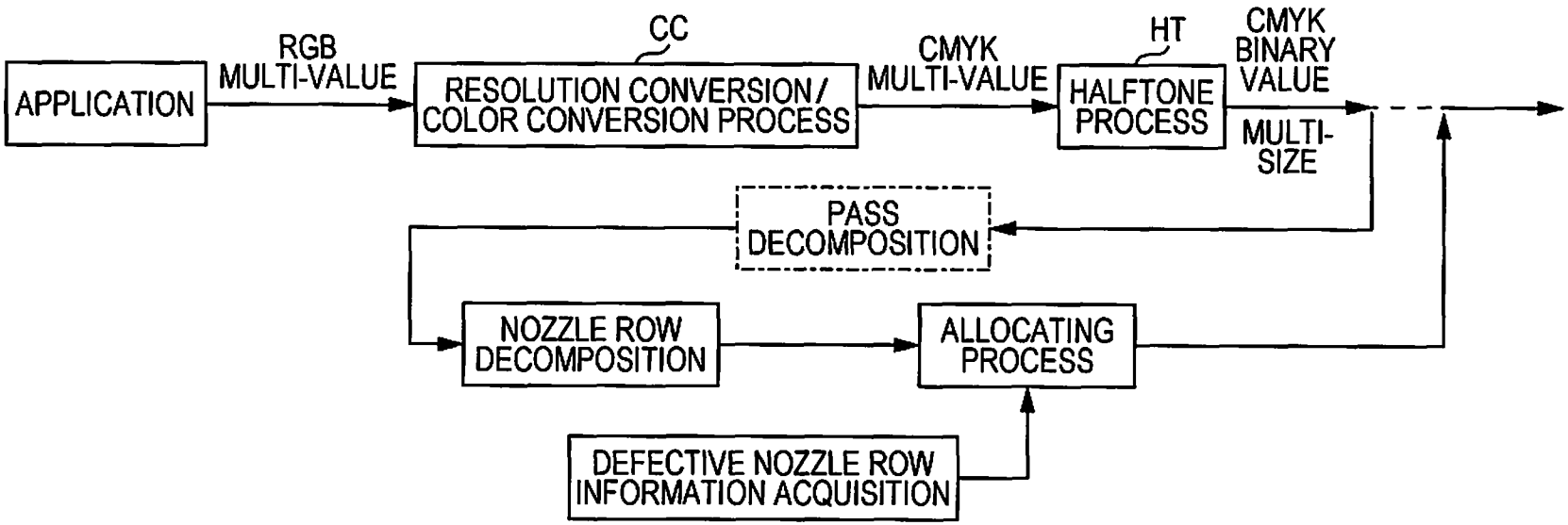
FIG. 3 is a view illustrating a flow of printing data.

FIG. 3 is a view illustrating printing data flow.

When printing is selected from an application, many applications output RGB multi-value data. The RGB multi-value printing data is input to an operating system (OS) and a printer driver. The printer 10 may receive instructions for printing from a tablet PC, a smartphone, or the like. In this case, there is no OS or printer driver, such that the printer 10 may directly input the RGB multi-value data.

In any case, the RGB multi-value data is first converted into CMYK (cyan, magenta, yellow, and black) multi-value data corresponding to respective dot pitches and ink colors through a resolution conversion/color conversion process CC. In the case of six-color inks using dark and light colors for cyan and magenta, multi-value data of Cl and Ml (light cyan and light magenta) is also added. The multi-value data indicates 8-bit (256) gray scales, 10-bit (1012) gray scales, or the like, depending on the number of bits of data that are allocated. In the case of multi-dot sizes, ink droplets are not binary values but are multi-values of two gray scales or more, and are usually not called multi-value data but are half tones.

The CMYK multi-value data is converted into CMYK binary value data through a halftone process HT. Due to the multi-dot sizes, the CMYK binary value data actually becomes 2-bit (4) gray scale data. Since the CMYK binary value data takes up sufficiently less space than gray scale value data such as 8-bit gray scale data or the like, and consequently indicates an on/off state of ink droplets of each size, the CMYK binary value data is also referred to as binary value data for convenience.

The CMYK binary value data includes dot positions, which are positions of dots when the ink droplets are printed on a printing medium, and amounts of ink discharged to the dot positions. In other words, the CMYK binary value data corresponds to printing data related to the dot positions and the amounts of ink discharged to the dot positions. Therefore, a process of generating CMYK binary value data based on the RGB multi-value data corresponds to a data generating section. In this example, since the application generates the RGB multi-value data, the process described above is performed. However, the data generating section includes variations. For example, the application may generate the CMYK multi-value data. In this case, a conversion process from the CMYK multi-value data to the CMYK binary value data corresponds to the data generating section. In addition, when the CMYK binary value data is supplied directly via a network, a process of inputting the CMYK binary value data corresponds to the data generating section.

Figure 4:
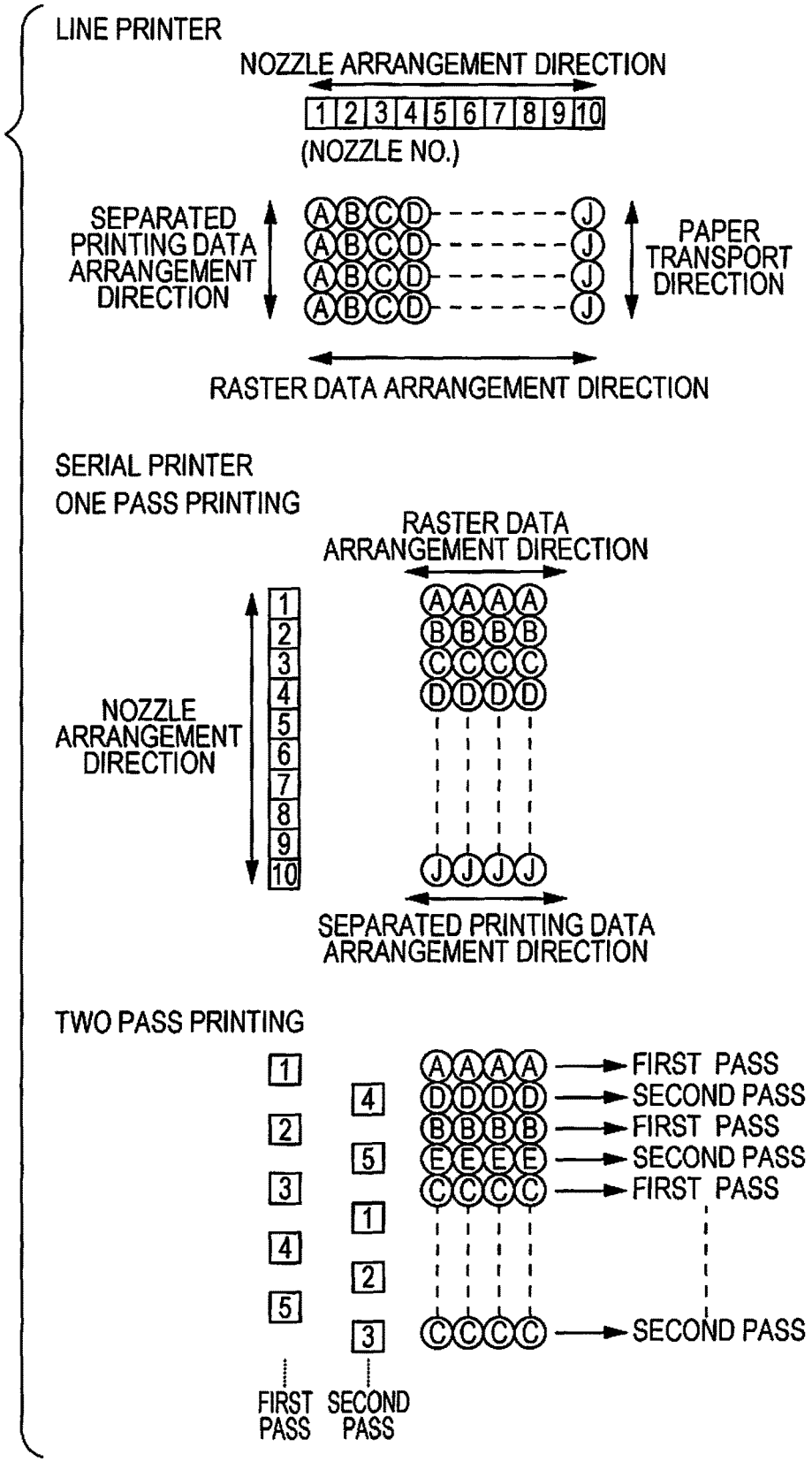
FIG. 4 is a view illustrating nozzle row decomposition and pass decomposition.

FIG. 4 is a view illustrating nozzle row decomposition and pass decomposition illustrated in FIG. 3.

When the CMYK binary value data is obtained, the CMYK binary value data is decomposed into data corresponding to nozzle rows in a direction in which a white streak is generated. As described above, in the line printer, the white streak is generated in a transport direction of the paper. The CMYK binary value data depends on data generated by the printer driver. When raster data is data in accordance with the width direction of the paper, the CMYK binary value data is orthogonal in accordance with the feed direction of the paper, which is a direction of printing data supplied to each nozzle. Here, a process of specifying the printing data that is to be specified for each nozzle is referred to as nozzle row decomposition. The nozzle row decomposition is performed, such that adjacent dot positions and printing data corresponding to each dot position correspond to each other. In the case where the printer driver generates the printing data in accordance with the feed direction of the paper, when the printing data is separated based on the positions of the nozzles, they are nozzle-row-decomposed. Printing data corresponding to nozzle Nos. 1, 2, 3, . . . are printing data of A, B, C, . . . illustrated in FIG. 4.

Meanwhile, in the serial printer, when the CMYK binary value data is raster data in accordance with the width direction of the paper, the direction coincides with an arrangement direction of printing data supplied to each nozzle. Therefore, when the printing data A, B, C . . . are separated based on nozzle Nos. 1, 2, 3, . . . , they are nozzle-row-decomposed.

In addition, in the case of the serial printer, when the nozzle pitch and the dot pitch coincide with each other, all the dot positions of the printing area can be printed with one pass, whereas when the nozzle pitch and the dot pitch do not coincide with each other, all the dot positions of the printing area cannot be printed one pass and with a plurality of passes is required. When the printing is performed with a plurality of passes, printing data corresponding to nozzles at the time of performing the printing with each pass is extracted from the raster data, such that printing data for each pass is generated. Such a process is referred to as pass decomposition.

In FIG. 4, a feed width of the paper per pass consists of 5 dot portions. In this case, with respect to nozzle Nos. 1, 2, 3, 4, and 5, a first row of the raster data is nozzle No. 1 of first pass, a second row of the raster data is nozzle No. 4 of second pass, a third row of the raster data is nozzle No. 2 of first pass, a fourth row of the raster data is nozzle No. 5 of second pass, and a fifth row of the raster data is nozzle No. 3 of first pass. Such a process corresponds to the pass decomposition.

When the printing is performed with a plurality of passes, a situation of physically adjacent nozzles and a situation of adjacent dot positions when the ink droplets are discharged can be specified in consideration of the pass decomposition. In other words, an ink droplet discharged from a nozzle adjacent to a defective nozzle is not necessarily adjacent to a dot position to which an ink droplet is provided when the defective nozzle is normal, and an ink droplet discharged from a nozzle that is not adjacent to the defective nozzle is adjacent to the dot position to which the ink droplet is provided when the defective nozzle is normal.

In the nozzle row decomposition, regardless of whether the number of passes is one or plural, a process of specifying the plurality of printing data that are sequentially adjacent to one another is performed. For example, dot positions to which nozzle No. 4 and nozzle No. 5 discharge ink droplets are adjacent to a dot position to which nozzle No. 2 discharges an ink droplet.

When a defective nozzle exists, the defective nozzle is specified, and the following allocating process is performed. There is known a technique of specifying a defective nozzle row by supplying a signal for inspection to a driving element of each nozzle, for example, a piezo element. In addition, it is also possible to generate printing data for a predetermined printing pattern to perform printing, see a printing result, specify a specific nozzle that is clogged, and input a nozzle number. Such an input operation may be performed using the operation panel/display section 16, by inputting data via a PC or the like, or through a universal serial bus (USB) memory device or the like. It is also possible to read the printing result by using a scanner, specify the clogged nozzle, generate data, and input the data. Each of these methods corresponds to a position information acquiring section that acquires a position of a defective nozzle (having a discharge defect) of a plurality of nozzles discharging ink onto a medium.

Such an allocating process includes two processes, that is, a process of specifying positions to which an amount of ink is to be allocated and a process of calculating an amount of ink to be allocated.

Figure 5A:
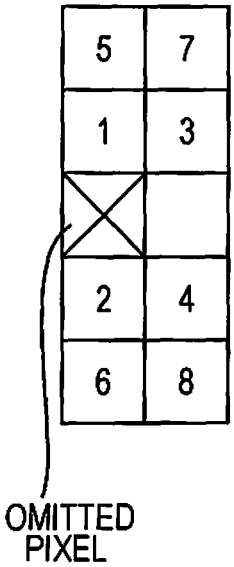
FIGS. 5A and 5B are views illustrating priorities in specifying positions to which an amount of ink is to be allocated.
Figure 5B:
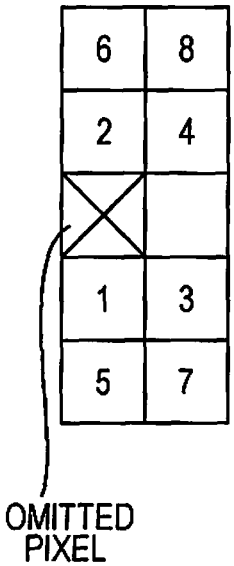

FIGS. 5A and 5B are views illustrating priorities in specifying positions to which an amount of ink is to be allocated, where FIG. 5A is a view for odd-numbered pixels and FIG. 5B is view for even-numbered pixels. The terms "odd-numbered" and "even-numbered" denote a sequence of dot positions from a printing start position.

In this example, priorities are set in a range of 2×5 pixels. When a position of a dot row to which an ink droplet is discharged from a defective nozzle is a third row, dots of the third row are missed, and are referred to as omitted pixels. The amount of ink corresponding to a missing dot due to an omitted pixel in a left column of the third row is sequentially allocated to neighboring dot positions based on priorities.

Allocating the amount of ink to the neighboring dot positions means specifying actual nozzles for ink droplets adhering to the dot position and at the same time, allocating the amount of ink of the printing data supplied to the specified nozzles. Different priorities are allocated to the dot positions for the following reason. Since there is an upper limit of an amount of ink at each dot position, even though the amount of ink is allocated to in the neighboring dot positions, the amount of ink cannot be allocated to the neighboring dot positions beyond the upper limit of the amount of ink. Accordingly, when an allocated amount of ink is insufficient to completely cover a dot position having a high priority, dot positions having low priorities are sequentially specified, and an amount of ink that is insufficient to cover the dot positions may be allocated to the dot positions. In this process, two processes, that is, the process of specifying the positions to which the amount of ink is to be allocated and the process of calculating the amount of ink to be allocated are performed.

In the present embodiment, a range of 2×5 pixels is set, and an allocating process is performed in this range. The range of 2×5 pixels is only an example and can be modified in consideration of an influence such as the size or the concentration of ink droplets, ease of penetration of the ink droplets into a medium, or the like. In general, it can be said that the allocating process is performed in a range of n×m pixels to which the ink droplets are provided as dots.

Here, n, which is an integer of 5 or more, is the number of pixels of the nozzle row direction in the printing data, and m, which is a natural number, is the number of pixels in a direction intersecting a nozzle row direction in the printing data.

In addition, in the present embodiment, m is set to 2. m can also be modified in consideration of an influence such as the size or a concentration of ink droplets, ease of penetration of the ink droplets into a medium, or the like, but it is preferable that m is about 2 in a range in which a print density change is not noticeable despite allocation of the amount of ink.

As described above, in priority information, priorities are set in a range of n×2 pixels.

In an example illustrated in FIG. 5A, a pixel having a first priority is a pixel positioned above a pixel of the left column of the third row by one pixel, a pixel having a second priority is a pixel positioned below the pixel of the left column of the third row by one pixel, a pixel having a third priority is a pixel positioned above the right of the pixel of the left column of the third row by one pixel, a pixel having a fourth priority is a pixel positioned below the right of the pixel of the left column of the third row by one pixel, a pixel having a fifth priority is a pixel positioned above the pixel of the left column of the third row by two pixels, a pixel having a sixth priority is a pixel positioned below the pixel of the left column of the third row by two pixels, a pixel having a seventh priority is a pixel positioned above the right of the pixel of the left column of the third row by two pixels, and a pixel having an eighth priority is a pixel positioned below the right of the pixel of the left column of the third row by two pixels. In general, the priorities are decreased while being allocated alternately to pixels above and below the pixel of the left column of the third row in a sequence starting with pixels close to the pixel of the left column of the third row.

In the priority information, priorities of the respective pixels in the priority information decrease sequentially as distances from the omitted pixel (first position) to the respective pixels increase.

As described above, when the defective nozzle is specified, a printing data corresponding to the defective nozzle is allocated to a central row (third row) of 2×5 pixels. The dot position to which the ink droplet is discharged from the defective nozzle is the left column of the third row, and such a pixel position is set as a first dot position. In other words, when the defective nozzle is not defective (normal), the position at which the ink droplet is discharged and printed on a medium is the first dot position. Next, a second dot position different from the first dot position is specified based on the priority information illustrated in FIGS. 5A and 5B. The priority is set for each pixel. In this manner, the second dot position based on the priorities is specified based on the position of the missing dot, and such a process corresponds to a specifying section.

The priorities in FIG. 5A and priorities in FIG. 5B are set so that the top and bottom thereof are reversed. Therefore, a dot position having a priority of 1 is positioned above the first dot position with respect to the odd-numbered pixels and is positioned below the first dot position with respect to the even-numbered pixels. When the priorities for the odd-numbered pixels and the even-numbered pixels are not reversed, an amount of ink corresponding to the missing dot is always allocated to the position above the omitted pixel, but when the priorities for the odd-numbered pixels and the even-numbered pixels are reversed, the amount of ink tends to be sequentially allocated to positions above and below the omitted pixel, such that unnaturalness can be solved.

As described above, the priority information is set so that the priorities are alternately changed on both sides having the omitted pixel (first position) interposed therebetween on the medium.

FIGS. 6A to 6E are views illustrating an allocating process in accordance with a specific example.

FIG. 6A illustrates original data. The original data is printing data that is nozzle-row-decomposed and supplied to each nozzle discharging dots provided on the medium. If an arrangement of the nozzles coincides with the dot positions on the medium, the original data coincides with printing data for actual nozzle rows.

Since the nozzles correspond to the multi-dot sizes, 0 indicates that a dot does not exist, 1 indicates a small dot, 2 indicates a medium dot, and 3 indicates a large dot. Thereafter, with respect to the respective dot positions, a right direction of an upper left pixel is defined as an x direction, a downward direction of the upper left pixel is defined as a y direction, and the respective pixels are specified by (x, y) coordinates. An upper left pixel position is (1, 1), and a lower right pixel position is (7, 5).

If a middle row (y=3) is a row corresponding to a defective nozzle, (1, 3) to (7, 3) become omitted pixels. Even though the first omitted pixel is (1, 3) and an original data is "3", this nozzle is a clogged defective nozzle and thus cannot discharge an ink droplet, and as a result printing data is equal to "0". That is, a print density corresponding to an amount of ink of a difference between 3 and 0 is insufficient.

The amount of ink not only refers to a pure volume, but may also be a stepped guideline value such as a large value, a medium value, and a small value. In the following description, it is assumed that dot values 0 to 3 in the printing data are treated equally as indicating amounts of ink.

If an x coordinate value is 1, the pixel is an odd-numbered pixel, and with reference to the priority information in FIG. 5A, a pixel with a high priority (in FIG. 5A, 1 is the highest priority and 8 is the lowest priority) is a pixel of (1, 2). That is, when the omitted pixel of (1, 3) is set as a first dot position, the pixel of (1, 2) is specified as a second dot position based on the priority information.

Originally, an insufficient amount of ink "3" is to be allocated, but original data of the pixel of (1, 2) is "1", and a maximum value of the pixel of (1, 2) is "3".

As a process of calculating the amount of ink, the following Step 1 to Step 6 are performed.

Step 1: acquire an amount of ink of a first dot position (an insufficient amount of ink that currently exists)

Step 2: acquire an amount of ink of a second dot position

Step 3: add the amount of ink of the first dot position and the amount of ink of the second dot position (set the result of addition of the added value)

Step 4: set whichever value of the added value and "3" id smallest to the amount of ink of the second dot position after the addition Step 5: subtract from the added value the amount of ink of the second dot position after the addition and carry forward a subtraction result as a remaining value when the subtraction result is a positive value Step 6: set the amount of ink of the first dot position to "0"

The abovementioned process corresponds to a process of allocating the amount of ink of the first dot position to the second dot position. This process is performed in a form of correcting the printing data. Performing this process corresponds to a data correcting section.

The abovementioned process is as follows when performed on the original data. An adjacent pixel refers to a pixel of which a priority is the next highest based on the priority information.

A: dot value of omitted pixel (first dot position)=3

B: dot value (before addition) of adjacent pixel (second dot position)=1

B': dot value (after addition) of adjacent pixel (second dot position)=(Min (3, A+B)=3

C: remaining dot value=(A+B)−B'=1

In this manner, the amount of ink of the second dot position is increased from "1" to "3", and "1" in which the insufficient amount is not supplemented is the remaining dot value.

The dot value of the first dot position is set to "0" in Step 6 because when detection of the defective nozzle is erroneous, if the original data remains, ink is also discharged from a nozzle considered to be the defective nozzle, such that ink is overlaps. In general, the dot value of the first dot position may be set to "0", but also includes a value in which an ink droplet is not substantially provided. As described above, the data correcting section sets the amount of ink of the first dot position to an amount of ink in which the ink droplet is not provided.

FIG. 6B illustrates a result of the abovementioned allocating process.

The fact that the remaining dot value is a positive value means that the insufficient amount of ink of the first dot position cannot be completely covered with only the second dot position, and a print density becomes insufficient. For this reason, a third dot position having the next highest priority is specified based on the priority information in FIGS. 5A and 5B. In this case, it can be recognized that a pixel of (1, 4) is the third dot position.

This process corresponds to a process in which the specifying section specifies the lower-priority dot position (third dot position) different from the higher-priority dot position (second dot position) based on the priority information. After the third dot position is specified, the data correcting section corrects the corresponding printing data so that the amount of ink that is allocated to the higher-priority dot position but cannot be completely covered with the higher-priority dot position (an amount of ink that cannot be completely covered with the second dot position even though a first amount of ink of the first dot position is allocated to the second dot position) is allocated to the lower-priority dot position (third dot position).

The allocation of the amount of ink to the third dot position is substantially the same as the allocation of the amount of ink from the first dot position to the second dot position. Accordingly, Step 7: acquire the previous remaining value (an insufficient amount of ink that currently exists)

Step 8: acquire an amount of ink of a dot position (for example, the third dot position) having the next priority based on the previous dot position Step 9: add the amount of ink of the second dot position and the amount of ink of the dot position (for example, the third dot position) having the next priority based on the previous dot position (set an addition result to an added value)

Step 10: set a smaller value of the added value and "3" to the amount of ink of the dot position (for example, the third dot position) having the next priority after the addition Step 11: subtract the amount of ink of the dot position (for example, the third dot position) having the next priority after the addition from the added value and carry forward a subtraction result as a remaining value when the subtraction result is a positive value The abovementioned process is as follows when performed on the original data (FIG. 6B) after the previous correction.

C: previous remaining dot value=1

B: dot value (before addition) of adjacent pixel (third dot position)=3

B': dot value (after addition) of adjacent pixel (third dot position)=(Min (3, C+B)=3

C: current remaining dot value=(C+B)−B'=1

FIG. 6C illustrates a result of the abovementioned allocating process.

Although the third dot position is specified, the amount of ink of the third dot position in the printing data is already a maximum value, such that the insufficient amount cannot be accepted, and thus, the remaining dot value is in a state in which it is not decreased.

This process is repeated until the remaining dot value is zero or until a pixel has the lowest priority.

The abovementioned process is as follows when performed on the original data (FIG. 6C) after the previous correction.

C: previous remaining dot value=1

B: dot value (before addition) of adjacent pixel (fourth dot position)=3

B': dot value (after addition) of adjacent pixel (fourth dot position) (Min (3, C+B)=3

C: current remaining dot value=(C+B)−B'=1

FIG. 6D illustrates a result of the abovementioned allocating process.

Since the remaining dot value exists, additionally, the abovementioned process is as follows when performed on the original data (FIG. 6D) after the correction.

C: previous remaining dot value=1

B: dot value (before addition) of adjacent pixel (fifth dot position)=2

B': dot value (after addition) of adjacent pixel (fifth dot position)=(Min (3, C+B)=3

C: current remaining dot value=(C+B)−B'=0

FIG. 6E illustrates a result of the abovementioned allocating process.

Since the remaining dot value is zero, the subsequent process is not performed. Since there are 8 pixels to be allocated, the process can be repeated up to 8 times.

When the number of times of the repetition exceeds 8, the allocating process is performed beyond the range of 5×2 pixels that is initially set. However, in the present embodiment, even though the remaining dot value is generated, the allocating process is not performed beyond the range of 5×2 pixels. The allocating process is not performed beyond the range of 5×2 pixels in order to shorten a process time by limiting the number of times of the repetition and in consideration of a level of an actual effect.

As described above, the allocating process is not performed beyond a range of n×2 pixels to which the ink droplets are provided as the dots.

FIGS. 7A to 7D are views illustrating an allocating process for the next omitted pixel (2, 3).

Referring to FIG. 7A, since an x coordinate value is 2, this pixel is an even-numbered pixel, and referring to the priority information in FIG. 5B, a pixel having the highest priority is a pixel of (2, 4). That is, when the omitted pixel (2, 3) is set as a first dot position, the pixel of (2, 4) is specified as a second dot position based on the priority information.

An insufficient amount of ink "2" is to be allocated, but since original data of the pixel of (2, 4) is "3", there is no amount of ink that can be allocated to this pixel. When performed, the process of Step 1 to Step 6 is as follows.

A: dot value of omitted pixel (first dot position)=2

B: dot value (before addition) of adjacent pixel (second dot position)=3

B': dot value (after addition) of adjacent pixel (second dot position)=(Min (3, A+B)=3

C: remaining dot value=(A+B)−B'=2

In the first original data, the amount of ink of the second dot position was "2", but as a result of allocating an amount of ink of the first omitted pixel, the original data is corrected when processing for the next omitted pixel starts. Specifically, amounts of ink of pixels of (2, 2) and (2, 4) are increased from "2" to "3", and it is impossible to allocate the insufficient amount of ink to these pixels.

As illustrated in FIG. 7*b*, the same applies to the pixel of (2, 2) of which a priority is "2".

When a dot value is 2 at a pixel of (3, 4) of which a priority is "3", Step 7 to Step 11 are performed, and the insufficient amount of ink can be covered for the first time. Here, C: previous remaining dot value=2

B: dot value (before addition) of adjacent pixel (fourth dot position)=2

B': dot value (after addition) of adjacent pixel (fourth dot position)=(Min (3, C+B)=3

C: current remaining dot value=(C+B)−B'=1

This result is illustrated in FIG. 7C.

Further, since a dot value is 2 at a pixel of (3, 2) of which a priority is "4", Step 7 to Step 11 are performed, such that the insufficient amount of ink can be covered.

Here, C: previous remaining dot value=1

B: dot value (before addition) of adjacent pixel (fifth dot position)=2

B': dot value (after addition) of adjacent pixel (fifth dot position)=(Min (3, C+B)=3

C: current remaining dot value=(C+B)−B'=0

This result is illustrated in FIG. 7D.

The remaining dot value becomes 0, such that the allocating process ends.

Figure 8:
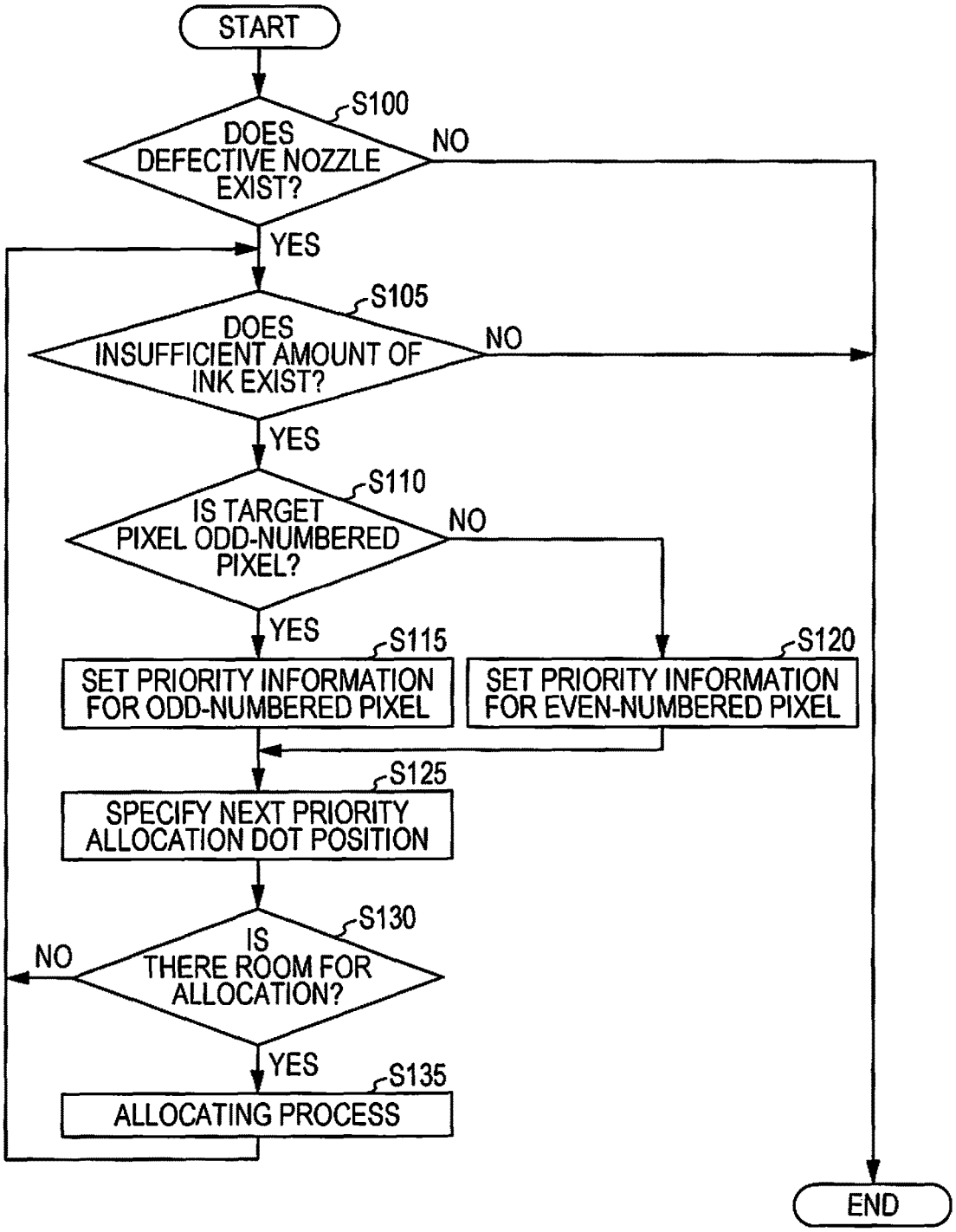
FIG. 8 is a flow chart when the allocating process is reflected in a program executed by a computer.

FIG. 8 illustrates a flow chart when the abovementioned allocating process is reflected in a program executed by a computer. The allocating process also appears in the flow of the data of FIG. 3.

First, in step S100, it is determined whether or not a defective nozzle exists. When no defective nozzle exists, the allocating process ends.

When a defective nozzle exists, it is determined in step S105 whether or not an insufficient amount of ink exists in a target pixel. The target pixel refers to lower-priority dot positions that start at the first dot position and are sequentially arranged.

When an insufficient amount of ink exists, it is determined in step S110 whether or not the target pixel is an odd-numbered pixel to specify priority information. When the target pixel is the odd-numbered pixel, priority information for the odd-numbered pixel is set in step S115, and when the target pixel is an even-numbered pixel, priority information for the even-numbered pixel is set in step S120.

In step S125, the next priority dot position is specified based on the set priority information. Since the next priority dot position is an allocation position, it is determined in step S130 whether or not there is room for allocation at this dot position. When there is room for allocation, a process of allocating the insufficient amount of ink described above is performed in step S135. A remaining dot value is also calculated by the allocating process. The remaining dot value becomes the next insufficient amount of ink. The allocating process is performed after it is determined in step S130 whether or not there is room for allocation, but whether or not there is room for allocation may also be determined during the allocating process. Next, step S105 and the subsequent steps are repeated. When there is no room for allocation, step S105 and the subsequent steps are repeated without performing the allocating process.

In this case, steps S105 to S125 correspond to the specifying section, and steps S130 and S135 correspond to the data correcting section.

A printing control apparatus is realized by hardware and software capable of performing the processes described above, and the processes performed by the printing control apparatus correspond to a printing control method. A program executed in accordance with the abovementioned processing sequence in the control circuit 20 or the PC 40 corresponds to a printing control program, and a medium such as a ROM or a hard disk in which the program is stored corresponds to a medium on which a printing control program is stored.

Second Embodiment

In the first embodiment described above, the insufficient amount of ink that can be completely covered and the amount of ink to be carried forward are calculated for each pixel. The insufficient amount of the print density can be accurately calculated, but the calculation is performed for each pixel, and throughput is thus increased. In addition, there is a viewpoint that it cannot be unconditionally decided whether or not a correction value of the print density by the allocation of the amount of ink to the neighboring dot positions becomes certainly an accurate value by finding data on the amount of ink through calculation. In particular, when the dot value and the amount of ink are not directly proportional to each other, it cannot be said that a calculation result based on the dot value is an accurate value of the insufficient amount of ink.

FIG. 9 is a view illustrating contents of a replacement table.

In the present embodiment, a value of an insufficient amount of ink to be allocated to other pixels such as a dot value A of an omitted pixel, a remaining dot value C, or the like, and a dot value B (before correction) of an adjacent pixel to which an amount of ink is to be allocated are used as arguments in the replacement table illustrated in FIG. 9 to refer to a dot value B' (after the correction) of the adjacent pixel preset in the replacement table and the current remaining dot value C'.

Reference values of the replacement table are appropriately set on the basis of the values calculated through the process of Step 1 to Step 6 and Step 7 to Step 11 and in consideration of an actual printing result and an empirically expected value.

A case different from the case of the values calculated through the process of Step 1 to Step 6 and Step 7 to Step 11 is a case in which the insufficient amount (A or C) of ink is 1 and a case in which the dot value B of the adjacent pixel before the correction is 2 or 3, and the remaining dot value C' is set to be larger than an original calculation value. That is, in the case in which a print density of an area to which dots are provided is high, the print density tends to be maintained slightly high by adjustment to account for a decrease in print density due to the omitted pixel.

Specifically, when A or C is 1, if the dot value B of the adjacent pixel before the correction is 2, the dot value B of the adjacent pixel is corrected to 3, such that the insufficient amount of ink is supplemented in a calculation. Therefore, the remaining dot value C' should be 0, but forcibly becomes 1.

In addition, when A or C is 1, if the dot value B of the adjacent pixel before the correction is 3, the dot value B of the adjacent pixel is not corrected in a state in which it is 3, and the insufficient amount of ink is carried forward as is in the calculation. Therefore, the remaining dot value C' should be 1, but forcibly becomes 2.

In either case, the result indicates adding 1 to the remaining dot value C1'.

On the contrary, when the remaining dot value C' that is generated in an original case is set to be small, a print density tends to be slightly low in the adjustment.

Further, it is possible not only to adjust the remaining dot value C1' but also to correct the dot value B of the adjacent pixel. For example, when the remaining dot value C' is 1 and the dot value B of the adjacent pixel before the correction is 2, the dot value B' of the adjacent pixel after the correction should be 3 in the calculation, but forcibly becomes 2, such that it is also possible to allocate the amount of ink to a pixel having the next priority.

In the correction of the printing data with reference to the replacement table, a process of the following Step 12 to Step 15 is performed.

Step 12: acquire an amount of ink (dot value A) of a first dot position or the previous remaining amount of ink (dot value C) (an insufficient amount of ink that currently exists)

Step 13: acquire an amount of ink (dot B) of a second dot position

Step 14: use the amount of ink of the first dot position and the amount of ink of the second dot position as arguments to refer to the replacement table and read an amount of ink of the second dot position after correction and the current remaining amount of ink (dot value C')

Step 15: correct printing data based on the read amount of ink (dot value)

Referring to the abovementioned example, when A or C is 1, if the dot value B of the adjacent pixel before the correction is 3, referring to the replacement table illustrated in FIG. 9, such case corresponds to an eighth column from the left, and the read dot value B' of the adjacent pixel is 3, and the current remaining dot value C' is 2.

A: dot value of omitted pixel (first dot position)=1

B: dot value (before correction) of adjacent pixel (second dot position)=3

B': dot value (after correction) of adjacent pixel (second dot position)=3

C': remaining dot value=2

As described above, in the present embodiment, the allocating process is performed with reference to correction values of the printing data corrected by the allocating process based on the replacement table, and a process of performing the allocating process corresponds to the data correcting section.

FIGS. 10A to 10E are views illustrating an allocating process using a specific example.

FIG. 10A illustrates a result obtained by performing the allocating process in a state in which the original data of FIG. 6A is used as a target, the omitted pixel of (1, 3) is set as the first dot position, and the second dot position corresponding to the next priority is specified.

Before the correction,

A: dot value of omitted pixel (first dot position)=3

B: dot value (before correction) of adjacent pixel (second dot position)=1, and referring to the replacement table of FIG. 9, such case corresponds to a fourteenth column from the left. As a result, B': dot value (after correction) of adjacent pixel (second dot position)=3

C': remaining dot value=1.

The second dot position is (1, 2), and the dot value 3 after the correction is reflected in FIG. 10A.

Since the remaining dot value is 1, when the next priority dot position (third dot position) is specified, the dot position becomes (1, 4).

C: previous remaining dot value=1

B: dot value (before correction) of adjacent pixel (third dot position)=3, and referring to the replacement table of FIG. 9, such case corresponds to an eighth column from the left. As a result, B': dot value (after correction) of adjacent pixel (third dot position)=3

C: current remaining dot value=1.

In this case, the dot value of the adjacent pixel (third dot position) is not corrected. In FIG. 10B, a dot value 3 that is the same as that before the correction is illustrated.

Since the remaining dot value is 1, when the next priority dot position (fourth dot position) is additionally specified, the dot position becomes (2, 2).

C: previous remaining dot value=1

B: dot value (before correction) of adjacent pixel (fourth dot position)=3, and referring to the replacement table of FIG. 9, such case corresponds to an eighth column from the left. As a result, B': dot value (after correction) of adjacent pixel (third dot position)=3

C: current remaining dot value=1.

In this case, the dot value of the adjacent pixel (fourth dot position) is not corrected. In FIG. 10C, a dot value 3 that is the same as that before the correction is illustrated.

Since the remaining dot value is 1, when the next priority dot position (fifth dot position) is specified, the dot position becomes (2, 4).

C: previous remaining dot value=1

B: dot value (before correction) of adjacent pixel (fifth dot position)=2, and referring to the replacement table of FIG. 9, such case corresponds to a seventh column from the left. As a result, B': dot value (after correction) of adjacent pixel (fifth dot position)=3

C: current remaining dot value=1.

In this case, the insufficient amount is in a state in which it is accounted for in the calculation, while a remaining dot value is generated in accordance with the replacement table. In FIG. 10D, a corrected dot value 3 is illustrated at the fifth dot position.

Since the remaining dot value is 1, when the next priority dot position (sixth dot position) is specified, the dot position becomes (1, 1).

C: previous remaining dot value=1

B: dot value (before correction) of adjacent pixel (sixth dot position)=1, and referring to the replacement table of FIG. 9, such case corresponds to a sixth column from the left. As a result, B': dot value (after correction) of adjacent pixel (sixth dot position)=2

C: current remaining dot value=0.

The remaining dot value becomes 0 in accordance with the current allocation, such that no additional carry-over is performed, and the allocating process thus ends. In FIG. 10E, a corrected dot value 2 is illustrated at the sixth dot position.

Next, the omitted pixel is shifted to (2, 3) and (3, 3), but only the priority information to be referenced is alternately changed between odd-numbered pixels and even-numbered pixels, and a process is the same as the process described above.

In the present embodiment, the process can also be performed according to the flow chart of FIG. 8, and the present embodiment is different from the case of the first embodiment only in that the allocating process of Step S135 is performed with reference to the replacement table illustrated in FIG. 9.

According to the invention, a printing control apparatus, a printing control method, and a medium storing a printing control program that can maintain a print density even when a defective nozzle exists can be provided.

It should be noted that the invention is not limited to the abovementioned embodiments. It can be understood by those skilled in the art that an embodiment realized by appropriately changing combinations of substitutable members, components, and the like disclosed in the abovementioned embodiments, an embodiment realized by appropriately using members, components, and the like that are not disclosed in the abovementioned embodiments but can be substitutes for the members, the components, and the like, disclosed in the abovementioned embodiments as the well-known technology, and changing combinations thereof, and an embodiment realized by appropriately using members, components, and the like that are not disclosed in the abovementioned embodiments but can be assumed to be substitutes for the members, the components, and the like disclosed in the abovementioned embodiments based on well-known technology, and changing combinations thereof, fall within the scope of the invention.

This application claims priority under 35 U.S.C. § 119 to Japanese Patent Application No. 2016-232940, filed Nov. 30, 2016. The entire disclosure of Japanese Patent Application No. 2016-232940 is hereby incorporated herein by reference.

What is claimed is:

1. A printing control apparatus comprising:

a position information acquiring section that acquires a position of a defective nozzle of a plurality of nozzles discharging ink onto a medium;

a data generating section that generates printing data related to dot positions corresponding to positions of dots at which ink droplets are printed on the medium and amounts of ink discharged to the dot positions;

a specifying section that specifies in the printing data a first dot position at which the defective nozzle discharges an ink droplet to print the ink droplet on the medium when the defective nozzle is not defective and that specifies in the printing data a second dot position different from the first dot position based on priority information in which priority is set for each pixel; and a data correcting section that corrects the printing data, the correcting corresponding to a process of allocating an amount of ink of the first dot position to the second dot position, the specifying section specifying a lower-priority dot position different from a higher-priority dot position based on the priority information, and the data correcting section correcting the printing data, the correcting corresponding to a process of allocating to the lower-priority dot position an amount of ink that is allocated to the higher-priority dot position, but that is not completely covered with the higher-priority dot position.

2. The printing control apparatus according to claim 1, wherein a pixel positioned close to the first dot position has a higher priority in the priority information and priorities of pixels in the priority information decrease sequentially as distances from the first dot position to the pixels increase.

3. The printing control apparatus according to claim 1, wherein the priority information is set such that the priorities are alternately changed on both sides having the first dot position interposed therebetween on the medium.

4. The printing control apparatus according to claim 1, wherein the specifying section and the data correcting section perform the allocating process in a range of n×m pixels to which the ink droplets are provided as dots, where n is an integer of 5 or more and is the number of pixels in the nozzle row direction in the printing data, and m is a natural number and is the number of pixels in a direction intersecting a nozzle row direction in the printing data.

5. The printing control apparatus according to claim 4, wherein in the priority information, the priorities are set in a range of n×2 pixels.

6. The printing control apparatus according to claim 4, wherein the specifying section and the data correcting section do not perform the allocating process beyond the range of n×m pixels to which the ink droplets are provided as the dots.

7. The printing control apparatus according to claim 1, wherein the data correcting section performs, based on a replacement table, the allocating process with reference to correction values of the printing data corrected by the allocating process.

8. The printing control apparatus according to claim 1, wherein the data correcting section sets the amount of ink of the first dot position to an amount of ink in which the ink droplet is not provided.

9. A printing control method comprising:

acquiring a position of a defective nozzle of a plurality of nozzles discharging ink onto a medium;

generating printing data related to dot positions corresponding to positions of dots at which ink droplets are printed on the medium and amounts of ink discharged to the dot positions;

specifying in the printing data a first dot position at which the defective nozzle discharges an ink droplet to print the ink droplet on the medium when the defective nozzle is not defective and specifying in the printing data a second dot position different from the first dot position based on priority information in which priority is set for each pixel; and correcting the printing data, the correcting corresponding to a process of allocating an amount of ink of the first dot position to the second dot position, the specifying including specifying a lower-priority dot position different from a higher-priority dot position based on the priority information, and the correcting corresponding to a process of allocating to the lower-priority dot position an amount of ink that is allocated to the higher-priority dot position, but that is not completely covered with the higher-priority dot position.

10. A non-transitory medium storing a printing control program, the printing control program causing a computer to execute:

a function of acquiring a position of a defective nozzle of a plurality of nozzles discharging ink onto a medium;

a function of generating printing data related to dot positions corresponding to positions of dots at which ink droplets are printed on the medium and amounts of ink discharged to the dot positions;

a function of specifying in the printing data a first dot position at which the defective nozzle discharges an ink droplet to print the ink droplet on the medium when the defective nozzle is not defective and specifying in the printing data a second dot position different from the first dot position based on priority information in which priority is set for each pixel; and a function of correcting the printing data, the correcting corresponding to a process of allocating an amount of ink of the first dot position to the second dot position, the specifying including specifying a lower-priority dot position different from a higher-priority dot position based on the priority information, and the correcting corresponding to a process of allocating to the lower-priority dot position an amount of ink that is allocated to the higher-priority dot position, but that is not completely covered with the higher-priority dot position.

* * * * *